US008070305B2

(12) United States Patent
Bratton

(10) Patent No.: US 8,070,305 B2
(45) Date of Patent: Dec. 6, 2011

(54) MULLION ASSEMBLY FOR A REFRIGERATED MERCHANDISER

(75) Inventor: Gregory Scott Bratton, Arnold, MO (US)

(73) Assignee: Hussmann Corporation, Bridgeton, MO (US)

( * ) Notice: Subject to any disclaimer, the term of this patent is extended or adjusted under 35 U.S.C. 154(b) by 218 days.

(21) Appl. No.: 12/436,292

(22) Filed: May 6, 2009

(65) Prior Publication Data

US 2010/0018232 A1 Jan. 28, 2010

Related U.S. Application Data

(60) Provisional application No. 61/137,010, filed on Jul. 25, 2008.

(51) Int. Cl.
*F21V 33/00* (2006.01)

(52) U.S. Cl. ..... 362/92; 62/246; 62/264; 362/217.05

(58) Field of Classification Search ..... 362/125, 362/126, 249.02, 133, 92, 217.05; 62/246, 62/264

See application file for complete search history.

(56) References Cited

U.S. PATENT DOCUMENTS

| | | | | |
|---|---|---|---|---|
| 6,578,979 | B2 * | 6/2003 | Truttmann-Battig | 362/92 |
| 7,824,056 | B2 * | 11/2010 | Madireddi et al. | 362/125 |
| 2001/0048595 | A1 * | 12/2001 | Richardson | 362/92 |
| 2005/0265019 | A1 * | 12/2005 | Sommers et al. | 362/217 |
| 2007/0195535 | A1 | 8/2007 | Artwohl et al. | |
| 2008/0186695 | A1 * | 8/2008 | Awai et al. | 362/92 |
| 2009/0196022 | A1 * | 8/2009 | Kelly et al. | 362/126 |
| 2010/0019689 | A1 * | 1/2010 | Shan | 315/294 |
| 2010/0135020 | A1 * | 6/2010 | Moore | 362/249.02 |

FOREIGN PATENT DOCUMENTS

| | | |
|---|---|---|
| EP | 0657708 | 6/1995 |
| WO | 2005119124 | 12/2005 |

OTHER PUBLICATIONS

Foodfresh Refrigeration Limited, Commercial Refrigeration & Catering Catalogue [online], undated, see especially the IARP EIS 214 and similar cabinets on pages 3 and 4. Available from: http://www.foodfresh.uk.com/Foodfresh_Brochure.pdf [Accessed Apr. 11, 2009].

Hussmann Corporation, Impact Excel, Four-Deck High Volume Bulk Convertible Merchandiser brochure, 2008, 2 pages.

Ingersoll-Rand Company Ltd., Hussmann Impact Excel, Single or Multi-Deck Produce Merchandiser brochure, Aug. 2008, 2 pages.

Hussmann Corporation, Hussmann Impact Elite, Hot Food Merchandiser With BKI Hot Food Wells brochure, 2007, 2 pages.

Hussmann Corporation, R3HV/CR3HV Refrigerated High Volume Deli Service and Self-Service Merchandiser brochure, 2007, 2 pages.

* cited by examiner

*Primary Examiner* — Evan Dzierzynski
(74) *Attorney, Agent, or Firm* — Michael Best & Friedrich LLP

(57) ABSTRACT

A refrigerated merchandiser including a case that defines a product display area adapted to support product. The case includes a frame that has at least one mullion assembly defining an opening into the product display area, and a door that is positioned over the opening. The mullion assembly includes a mullion, a light assembly that is coupled to the mullion and that has a light source for illuminating at least a portion of the product display area, and a reflective surface that is coupled to at least one side of the mullion assembly and that extends along a length of the mullion. The reflective surface is visible from outside the case to increase visibility of product within the product display area.

17 Claims, 6 Drawing Sheets

MULLION ASSEMBLY FOR A REFRIGERATED MERCHANDISER

RELATED APPLICATIONS

This patent application claims priority to U.S. Patent Application Ser. No. 61/137,010 filed Jul. 25, 2008, the entire contents of which are hereby incorporated by reference.

BACKGROUND

The present invention relates to a refrigerated merchandiser that includes a mullion assembly, and more particularly, the present invention relates to a refrigerated merchandiser that includes a mullion assembly to increase visibility of a product display area.

In conventional practice, commercial businesses such as supermarkets and convenience stores are equipped with refrigerated merchandisers. Some of these merchandisers are provided with doors that are attached to vertically oriented mullion assemblies, and are used for presenting perishable food or beverages to customers within a product display area while maintaining the fresh food or beverages in a refrigerated environment. The mullion assemblies support the doors and provide an area upon which door gaskets can be sealed to seal the refrigerated product display area from the surrounding ambient environment. Often, the mullion assemblies include a light source that illuminates the product display area for better marketing of the food product and for higher visibility to the customers.

FIGS. 1-4 show one example of an existing refrigerated merchandiser 10 that includes mullion assemblies 15. The mullion assemblies 15 are relatively large and obstruct the view of food product that is positioned in a product display area 20. Generally, the viewability of food product in the product display area 20 by a consumer or store personnel from outside the merchandiser 10 along an angled viewing perspective or line 25 is substantially obstructed by the mullion assemblies 15. The amount of obstruction that is caused by the existing mullion assemblies 15 increases relative to the distance at which the consumer views the food product. In other words, the farther away a consumer is positioned relative to the food product that is desired to be viewed, the more the mullion assemblies 15 obstruct the view of the desired food product. As such, consumers must be relatively close to a desired food product to view the food product.

Some conventional refrigerated merchandisers are open to the surrounding atmosphere. Often moist air penetrates the product display area, which can generate frost within the refrigerated product display area and increase energy that is required to maintain the refrigerated environment within the product display area.

SUMMARY

The invention provides an improved merchandiser configured to display product supported in a product display area effectively and efficiently. In one construction, the invention provides a mullion assembly that includes a reflective surface that enables improved display of the products in the product display area.

In one construction, the invention provides a refrigerated merchandiser that includes a case defining a product display area adapted to support product. The case includes a frame that has at least one mullion assembly defining an opening into the product display area, and a door that is positioned over the opening. The mullion assembly includes a mullion, a light assembly that is coupled to the mullion and that has a light source for illuminating at least a portion of the product display area, and a reflective surface that is coupled to at least one side of the mullion assembly and that extends along a length of the mullion. The reflective surface is visible from outside the case to increase visibility of product within the product display area.

In another construction, the invention provides a method of retrofitting a refrigerated merchandiser including a case defining a product display area. The case has a frame with at least one mullion assembly defining an opening, and a door positioned over the opening. The method includes providing a reflective surface having true color reflection, and attaching the reflective surface to a mullion of the mullion assembly.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, unless specified or otherwise limited, "connected" and "coupled" are not restricted to physical or mechanical connections or couplings.

Figure 2:
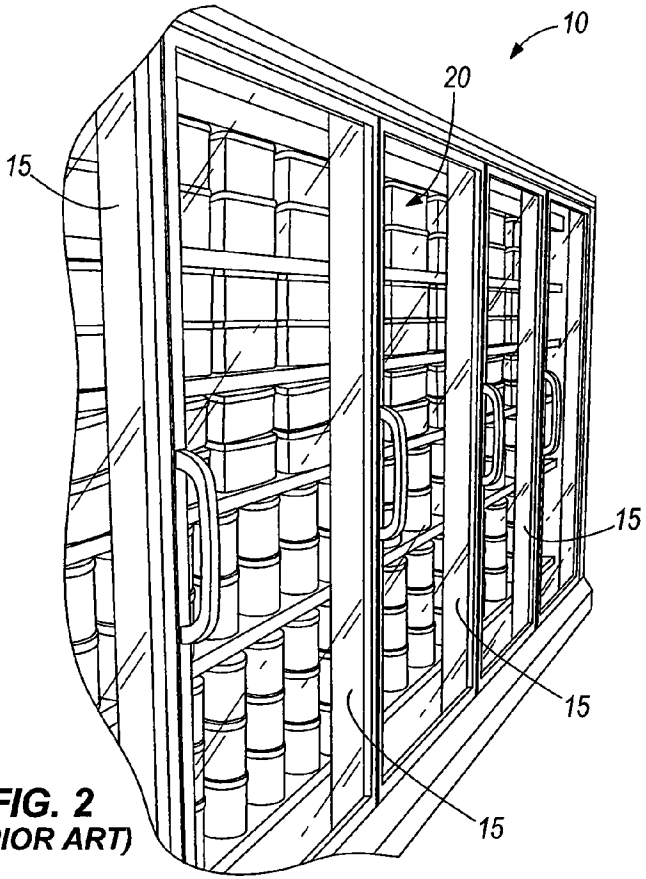
FIG. 2 (PRIOR ART)
FIG. 2 is another perspective view of a portion of the refrigerated merchandiser of FIG. 1.
Figure 1:
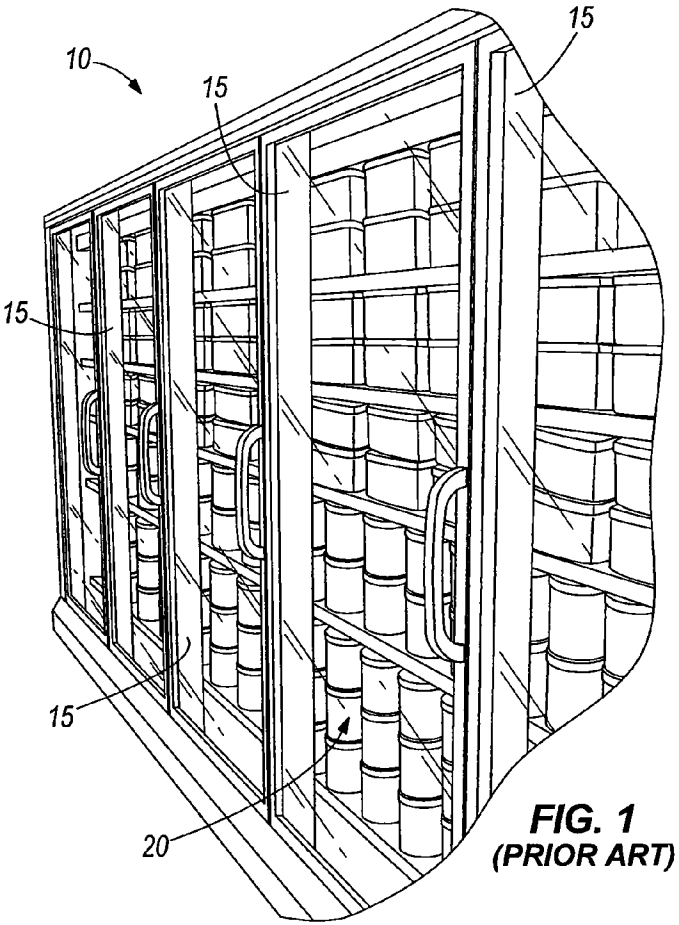
FIG. 1 (PRIOR ART)
FIG. 1 is a perspective view of a portion of a prior art refrigerated merchandiser.
Figure 3:
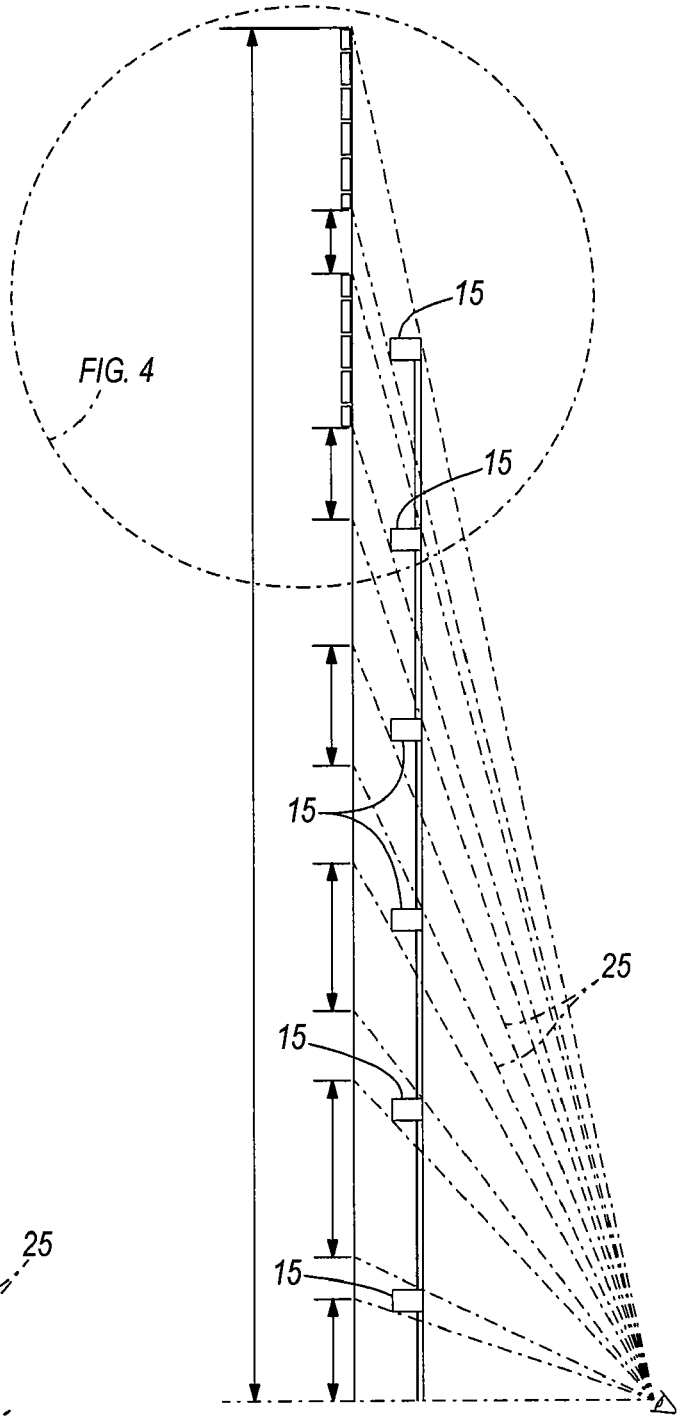
FIG. 3 (PRIOR ART)
FIG. 3 is a schematic view of the refrigerated merchandiser of FIG. 1.
Figure 4:
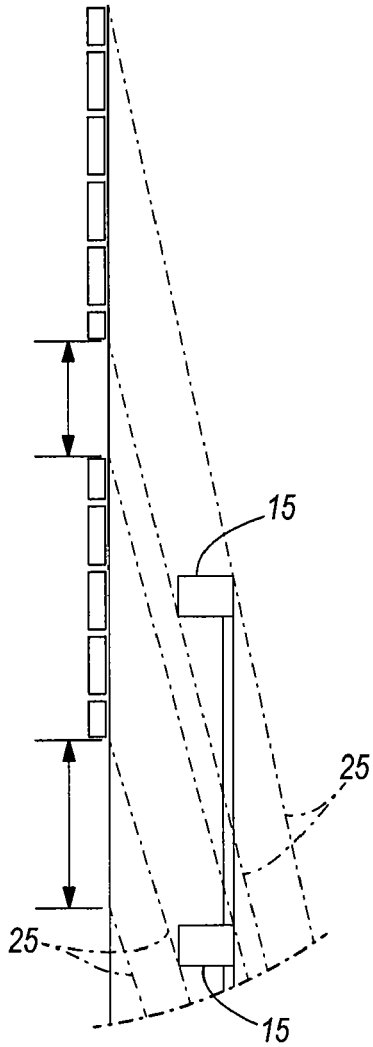
FIG. 4 (PRIOR ART)
FIG. 4 is an enlarged schematic view of the refrigerated merchandiser of FIG. 3.
Figure 5:
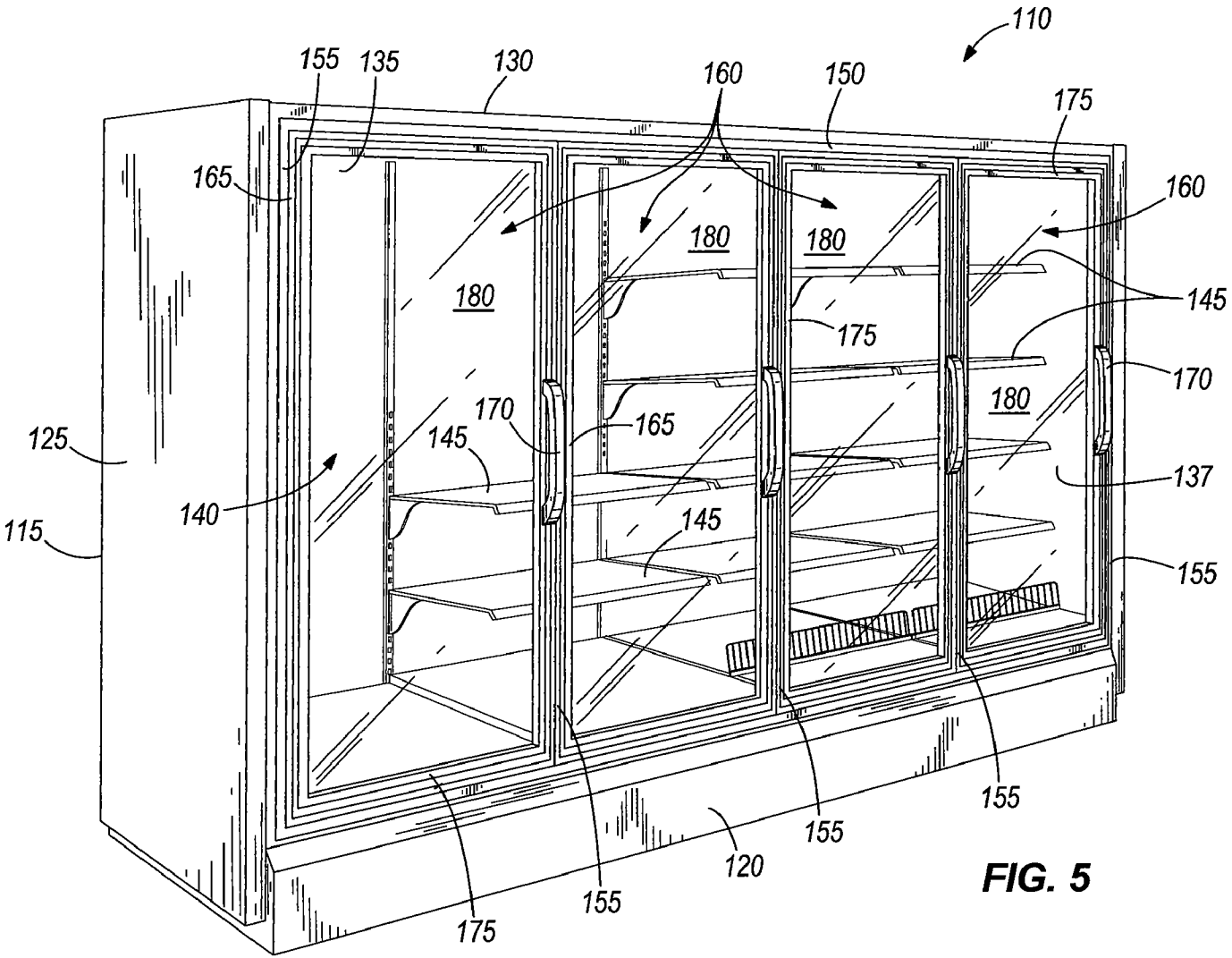
FIG. 5 is a perspective view of an exemplary refrigerated merchandiser embodying the present invention.

FIG. 5 shows a merchandiser 110 for displaying food product (e.g., frozen food, fresh food, beverages, etc.) available to consumers in a retail setting (e.g., a supermarket or grocery store). The merchandiser 110 includes a case 115 that has a base 120, side walls 125, a case top or canopy 130, and a rear wall 135. At least a portion of a refrigeration system (not shown) can be located within the case 115 to refrigerate the food product. In other constructions, a heating system can be located within the case 115 to heat the food product. The area partially enclosed by the base 120, the side walls 125, the case top 130, and the rear wall 135 defines a product display area 140. The food product is supported on shelves 145 within the product display area 140.

Figure 6:
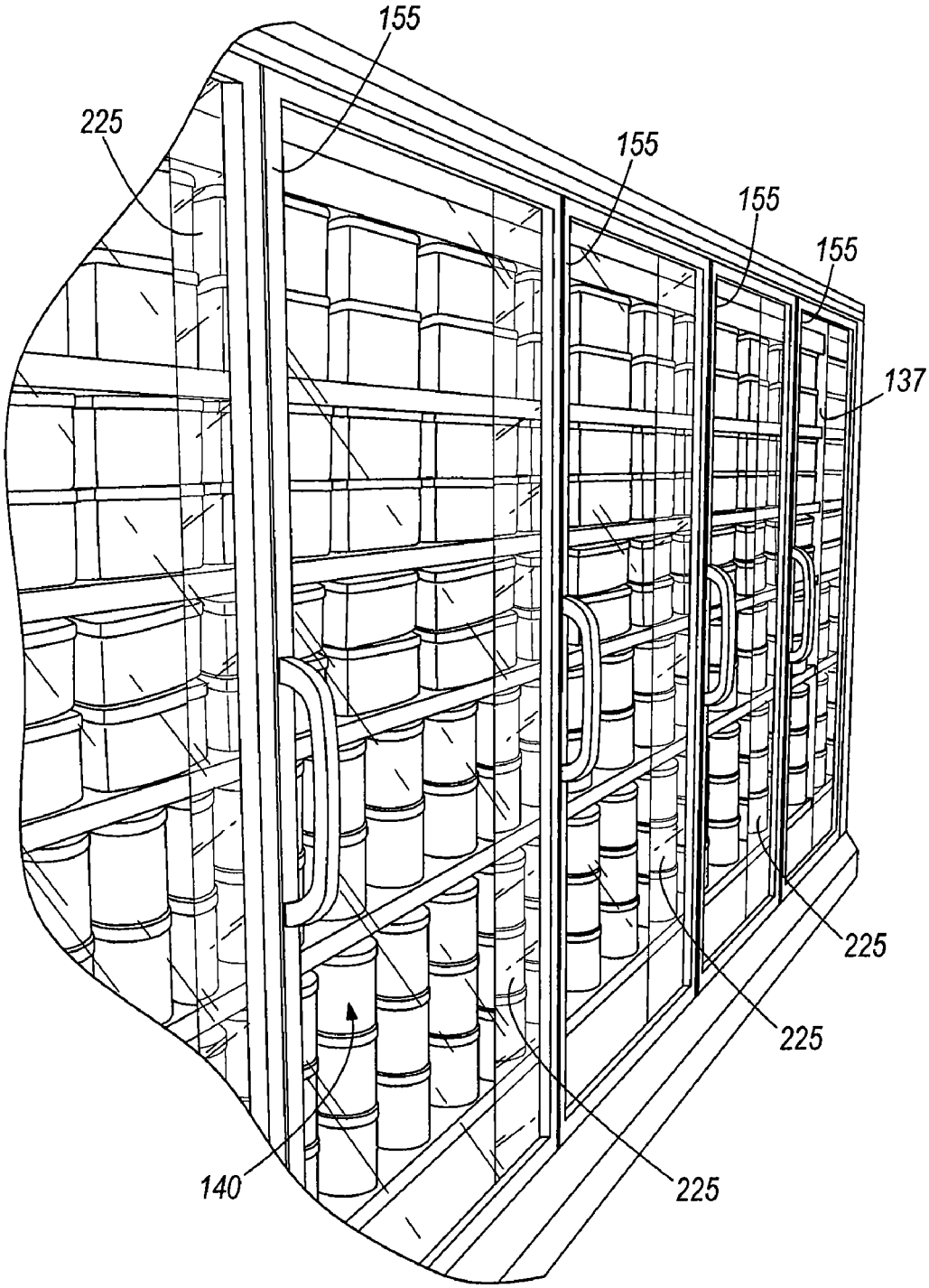
FIG. 6 is a perspective view of a portion of the refrigerated merchandiser of FIG. 5 including mullion assemblies.

FIGS. 5 and 6 show that the side walls 125 include interior surfaces 137 (one shown). In the illustrated construction, the interior surfaces 137 are non-reflective surfaces. In other constructions, the interior surfaces 137 may include glossy-black paint, polished stainless steel material, or a mirror.

Figure 7:
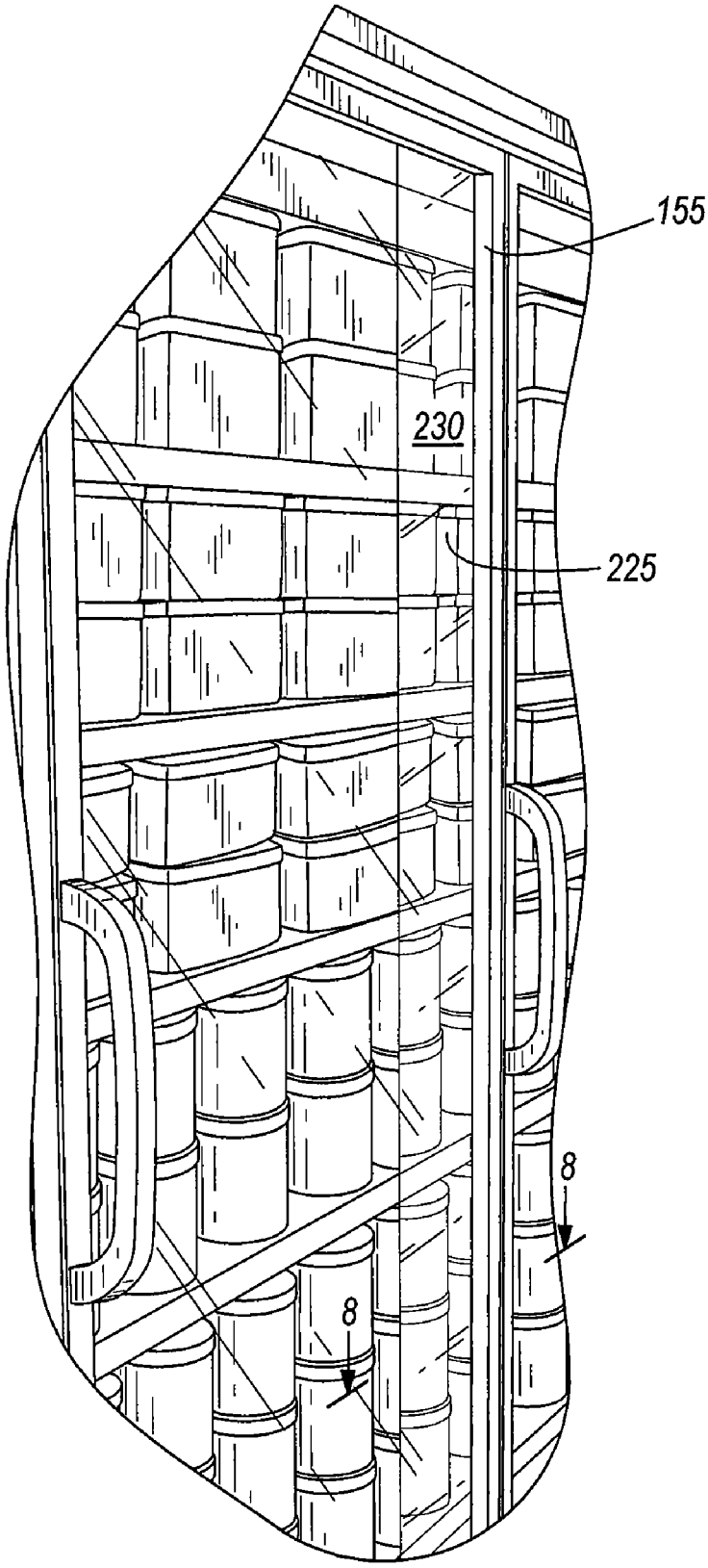
FIG. 7 is an enlarged perspective view of the refrigerated merchandiser of FIG. 6.
Figure 8:
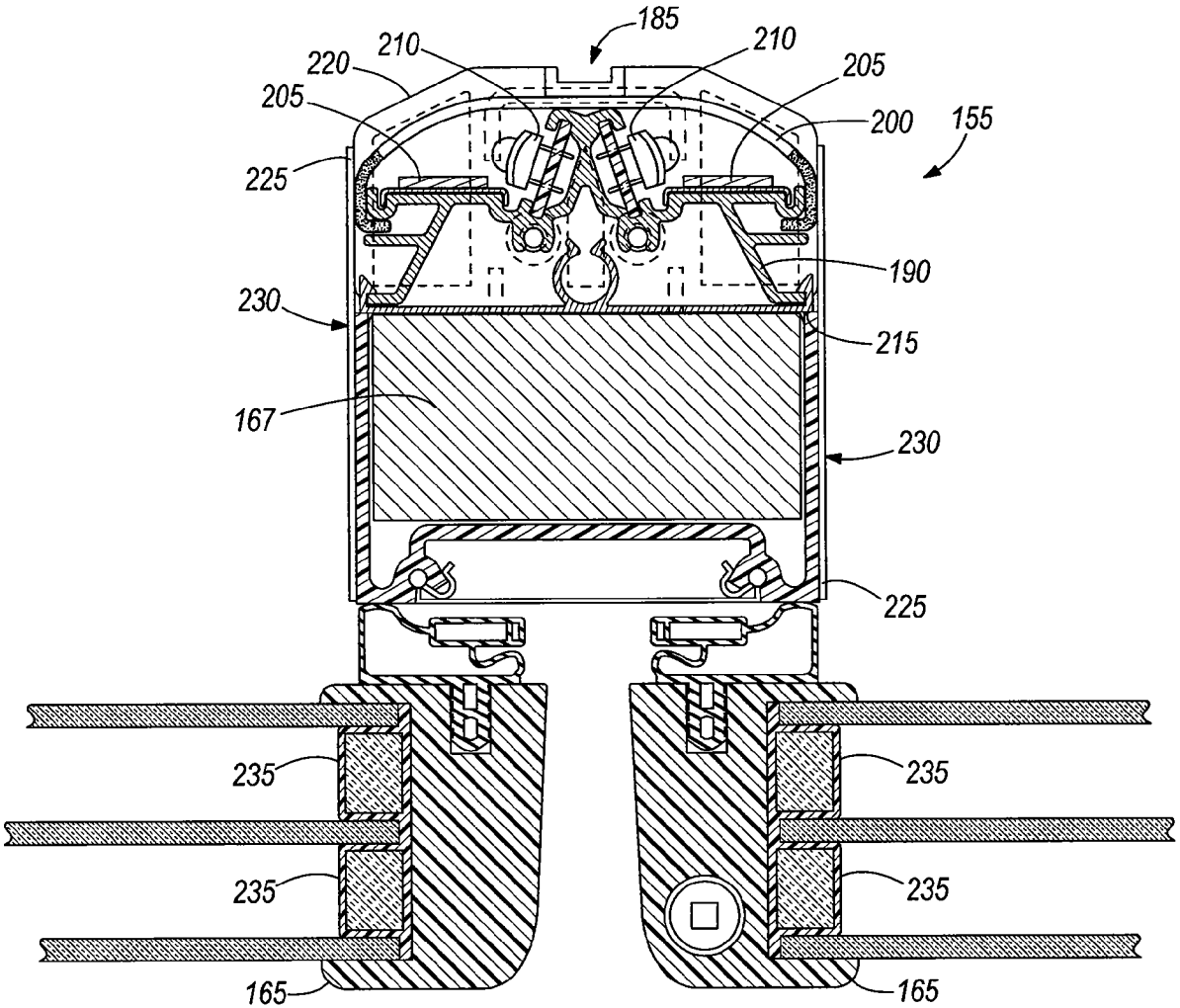
FIG. 8 is section view of one mullion assembly of the refrigerated merchandiser of FIG. 5.

The case 115 includes a frame 150 adjacent a front of the merchandiser 110. FIGS. 5-7 show that the frame 150 includes vertical mullion assemblies 155 that define openings 160, and doors 165 positioned over the openings 160. The openings 160 and the doors 165 are configured to allow access to food product stored in the product display area 140. The mullion assemblies 155 are spaced horizontally along the case 115 to provide structural support for the case 115. FIG. 8 shows that each mullion assembly 155 is defined by a structural member or mullion 167 that can be formed from a non-metallic or metallic material. The mullions 167 act as a base for the doors 165 and cooperate with gaskets surrounding the doors 165 to effectively seal the product display area 140 from the ambient environment. As shown in FIGS. 5 and 6, a handle 170 is positioned along an edge of each door 165 to move the door 165 between an open position and a closed position.

Each door 165 includes a frame 175 that attaches a translucent member 180 to the door 165 to allow viewing of the food product from outside the case 115. The translucent member 180 can be formed from glass, or alternatively, from other materials that are substantially translucent (e.g., acrylic, etc.).

FIG. 8 illustrates one mullion assembly 155 that is located between adjacent doors 165. It should be understood that the mullion assemblies 155 located adjacent the side walls 125 (i.e., the end wall mullion assemblies 155) are similar in construction to the mullion assembly 155 illustrated in FIG. 8 and described herein, except that each end wall mullion assembly 155 includes only a lateral half of the full mullion assembly 155. FIG. 8 shows that the mullion assembly 155 includes a light assembly 185 that can be attached to each mullion 167 of the case 115 to illuminate the product display area 140. In some constructions, the light assembly 185 includes a housing or shell 190, a translucent lens or cover 200, mirrors or specular members 205, and light emitting diode (LED) light sources 210. The housing 190 can be attached to each mullion 155 using a clip or retainer 215, or another similar fastener. The clip 215 can be coupled to the mullions 155 using fasteners (e.g., screws, bolts, etc.). In some constructions, the light assembly 185 also includes light emitting diode (LED) light sources 190. In other constructions, the light assembly 185 can include other light sources (e.g., fluorescent, etc.).

In some constructions, end caps 220 can be attached to the housing 190 to limit accumulation of debris within the light assemblies 185. Generally, the end caps 220 are removable from the housing 190. The cover 200 is attached to the housing 190 to protect the light sources 210 from debris or incidental contact.

FIGS. 6-8 show that a mullion or reflective member 225 is attached to sides of the mullion assembly 155. Due to the position of the end wall mullion assemblies 155 adjacent the side walls 125, the end wall mullion assemblies 155 include the reflective member 225 on only one side of the mullion assembly 155. The mullion member 225 includes a highly reflective surface 230 that provides a clear view of the food product within the product display area 140 without removing the mullion assembly 155 from the case 115. In some constructions, the mullion members 225 can be formed from polished stainless steel material. In other constructions, the mullion members 225 can be formed from a mirror. In still other constructions, the mullion members 225 can be formed from other reflective material.

Each mullion member 225 has true color reflection that reflects product without distortion. The highly reflective surface of the mullion members 225 maximizes visibility of the product by virtually eliminating viewing obstructions associated with conventional merchandisers. The true color reflection of the mullion members 225 provides a reflected product that is an accurate or precise representation of the product supported in the product display area (albeit a reverse image reflection). In other words, upon initial viewing, the reflected product has a realistic appearance to a viewer from outside the case 115, and the true color reflection provided by the mullion members 225 draws attention to the product in the product display area 140 instead of structural components of the merchandiser 110 (e.g., the mullion assemblies 155).

In the illustrated construction, each of the mullion members 225 is attached to the side of the mullion assembly 155. In these constructions, the mullion member 225 can be attached using an adhesive (e.g., glue, epoxy, etc.), welding, or other attachment means (e.g., bolts, screws, other fasteners, etc.). In other constructions, the mullion member 225 can be formed as part of the mullion assembly 155 (i.e., the mullion member 225 is formed with the mullion assembly 155 as a single piece).

The mullion members 225 may be installed in the original refrigerated merchandiser 110, or alternatively, in the merchandiser 110 in retrofit applications. In particular, the merchandiser 110 may be an existing merchandiser that is retrofitted with one or more mullion members 225 by attaching the mullion members 225 to one or both sides of the mullion assemblies 155.

The mullion members 225 reflect at least some product that is supported in the product display area along a substantial length of the mullions 167. The reflective surfaces 230 of the mullion members 225 make a portion of the associated mullion assembly 155 virtually disappear to provide attractive food product facings. In other words, relative to the actual size of the mullion assemblies 155 and in particular the distance to which the mullion assemblies 155 extend into the product display area 140, the reflective surfaces 230 make the mullion assemblies 155 appear much smaller in size (i.e., the mullion assemblies 155 appear to extend a relatively short distance into the product display area 140). The reflectivity of the mullion members 225 increases the visibility of the food product that is supported in the product display area 140 along the angled viewing perspective relative to conventional merchandisers by reflecting a portion of the food product outward from the case 115 without directly reflecting light from the light assemblies 185.

The mullion members 225 increase the visibility of the food product when viewed at an angle from outside the case 115. In this manner, the reflective mullion members 225 provide an effective way to make the food product easier to view and to find without removing structural components from the case 115. In some constructions, the doors 165 can include reflective material to further enhance the reflectivity of the food product. In other constructions, other components of the case 115 (e.g., the frames 150, door spacers or glass packs 235 within the doors 165, etc.) can include one or more reflective surfaces to reflect the food product.

Various features and advantages of the invention are set forth in the following claims.

What is claimed is:

1. A refrigerated merchandiser comprising:

a case defining a product display area adapted to support product, the case including a frame having at least one mullion assembly defining an opening into the product display area and a door positioned over the opening, the mullion assembly including a mullion, a light assembly coupled to the mullion and including a light source for illuminating at least a portion of the product display area, and a reflective surface coupled to at least one side of the mullion assembly and extending along a length of the mullion, the reflective surface being visible from outside the case to increase visibility of product within the product display area.

2. The refrigerated merchandiser of claim 1, wherein the reflective surface is positioned on one side of the mullion, and wherein the mullion assembly includes another reflective surface positioned on an opposite side of the mullion.

3. The refrigerated merchandiser of claim 1, wherein the reflective surface is formed with the mullion as a single piece.

4. The refrigerated merchandiser of claim 1, wherein the reflective surface is formed from one of a polished stainless steel material and a mirror.

5. The refrigerated merchandiser of claim 1, wherein the case includes at least two mullion assemblies, and wherein each of the mullion assemblies has a mullion and a reflective surface coupled to the mullion.

6. The refrigerated merchandiser of claim 1, wherein the reflective surface is attached to the mullion assembly using attachment means.

7. The refrigerated merchandiser of claim 1, wherein the reflective surface is positioned adjacent the light assembly to make the mullion assembly appear much smaller in size.

8. The refrigerated merchandiser of claim 1, wherein the reflective surface extends along a substantial length of the mullion.

9. The refrigerated merchandiser of claim 1, wherein the reflective surface is adapted to make at least a portion of the mullion assembly virtually disappear from view.

10. A method of retrofitting a refrigerated merchandiser including a case defining a product display area, the case having a frame with at least one mullion assembly defining an opening and a door positioned over the opening, the method comprising:

providing a reflective surface having true color reflection;

attaching the reflective surface to a mullion of the mullion assembly; and reflecting at least some product supported in the product display area and increasing visibility of the product from outside the case.

11. The method of claim 10, further comprising reflecting product supported in the product display area along a substantial length of the mullion.

12. The method of claim 10, further comprising reflecting product supported in the product display area and making at least a portion of the mullion assembly virtually disappear from view.

13. The method of claim 10, further comprising attaching reflective surfaces to opposite sides of the mullion assembly.

14. The method of claim 10, wherein attaching the reflective surface to the mullion includes adhering the reflective surface to the mullion.

15. The method of claim 10, further comprising positioning the reflective surface adjacent a light assembly of the mullion assembly.

16. The method of claim 15, further comprising increasing visibility of product within the product display area without directly reflecting light from the light assembly.

17. The merchandiser of claim 10, wherein the reflective surface makes the mullion assembly appear much smaller in size.

* * * * *